US009551328B2

(12) United States Patent
Frey et al.

(10) Patent No.: US 9,551,328 B2
(45) Date of Patent: Jan. 24, 2017

(54) SEAL-LESS PISTON PUMP FOR LIQUEFIED GAS

(71) Applicant: DELAWARE CAPITAL FORMATION, INC., Wilmington, DE (US)

(72) Inventors: Michael E Frey, Grand Rapids, MI (US); Richard E Foster, Grand Rapids, MI (US); Michael D Walters, Hudsonville, MI (US); Jeffrey Jay Sietsema, Jenison, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 274 days.

(21) Appl. No.: 14/207,977

(22) Filed: Mar. 13, 2014

(65) Prior Publication Data

US 2014/0271262 A1 Sep. 18, 2014

Related U.S. Application Data

(60) Provisional application No. 61/791,881, filed on Mar. 15, 2013.

(51) Int. Cl.

| | |
|---|---|
| ***F04B 9/137*** | (2006.01) |
| ***F02M 39/02*** | (2006.01) |
| ***F04B 15/08*** | (2006.01) |
| ***F04B 17/04*** | (2006.01) |
| ***F04B 35/04*** | (2006.01) |
| *F04B 49/03* | (2006.01) |

(52) U.S. Cl.

CPC ..... *F04B 9/1372* (2013.01); *F02M 39/02* (2013.01); *F04B 15/08* (2013.01); *F04B 17/042* (2013.01); *F04B 17/044* (2013.01); *F04B 35/045* (2013.01); *F04B 49/03* (2013.01)

(58) Field of Classification Search

CPC ..... F02M 39/02; F04B 9/127; F04B 9/1372; F04B 15/08; F04B 2015/081; F04B 2203/09; F04B 2203/10; F15B 15/086; H02K 49/102

See application file for complete search history.

(56) References Cited

U.S. PATENT DOCUMENTS

| | | | | |
|---|---|---|---|---|
| 461,295 A | | 10/1891 | Van Depoele | |
| 3,779,401 A | * | 12/1973 | Carroll | B65G 35/00 198/619 |
| 3,994,539 A | * | 11/1976 | Gottlieb | F15B 15/1414 384/49 |
| 4,043,709 A | * | 8/1977 | Grevich | F01L 23/00 417/404 |

(Continued)

OTHER PUBLICATIONS

The International Search Report and Written Opinion of the International Searching Authority for PCT/US2014/025451, date completed Aug. 7, 2014, date mailed Aug. 18, 2014.

(Continued)

*Primary Examiner* — Devon Kramer
*Assistant Examiner* — Joseph Herrmann
(74) *Attorney, Agent, or Firm* — Miller Canfield Paddock and Stone; Mark L Maki

(57) ABSTRACT

A fuel supply system for a vehicle uses a seal-less piston LPG injunction pump which pumps fluid from a storage tank to an engine. The pump uses the vehicle's pneumatic air system, wherein the pressurized air of this system alternatingly drives an actuator magnetically coupled to a piston.

29 Claims, 9 Drawing Sheets

(56) References Cited

U.S. PATENT DOCUMENTS

| | | | | |
|---|---|---|---|---|
| 4,145,165 | A * | 3/1979 | Perkins | E21B 21/01 310/80 |
| 4,231,722 | A * | 11/1980 | Teichmann | F04B 53/101 417/418 |
| 4,334,180 | A | 6/1982 | Bramm et al. | |
| 4,365,942 | A | 12/1982 | Schmidt | |
| 4,541,787 | A | 9/1985 | DeLong | |
| 4,692,673 | A | 9/1987 | DeLong | |
| 4,824,335 | A | 4/1989 | Lubitz | |
| 4,965,864 | A | 10/1990 | Roth et al. | |
| 5,094,426 | A * | 3/1992 | Zajac | F16K 31/1221 251/129.05 |
| 5,255,591 | A * | 10/1993 | Gottlieb | F16F 9/54 92/117 R |
| 5,899,672 | A | 5/1999 | Salamey | |
| 6,132,188 | A | 10/2000 | Brunee | |
| 6,203,288 | B1 | 3/2001 | Kottke | |
| 6,283,720 | B1 | 9/2001 | Kottke | |
| 6,506,030 | B1 | 1/2003 | Kottke | |
| 6,851,938 | B2 | 2/2005 | Ding et al. | |
| 6,857,780 | B2 | 2/2005 | Morr | |
| 6,931,983 | B2 * | 8/2005 | Meucci | F04B 9/133 417/418 |
| 7,644,648 | B2 * | 1/2010 | Minowa | F15B 15/086 92/169.1 |
| 2003/0044285 | A1 | 3/2003 | Ding et al. | |
| 2009/0191073 | A1 | 7/2009 | Kopecek et al. | |

OTHER PUBLICATIONS

Catalog Ultran Cylinders, publication date unknown, published at least as early as Mar. 15, 2012. (54 pages).

* cited by examiner

SEAL-LESS PISTON PUMP FOR LIQUEFIED GAS

CROSS REFERENCE TO RELATED APPLICATIONS

This application asserts priority from provisional application 61/791,881, filed on Mar. 15, 2013, which is incorporated herein by reference.

FIELD OF THE INVENTION

The invention relates to a seal-less piston pump, and more particularly, to a seal-less liquid propane injection pump for an engine such as a diesel engine on a vehicle.

BACKGROUND OF THE INVENTION

In conventional diesel engines, it is known to inject liquid propane (LPG) into the fuel-air mixture in the fuel header or manifold of the engine. This is done to reduce emissions and increase performance of the vehicle. Typically, the vehicle would include an LPG tank and a pump which is in fluid communication with the LPG tank and pumps the LPG or other fluid into the engine manifold. In a known configuration, such a pump may be an in-tank, submersible turbine pump. However, such a configuration is known to have disadvantages associated therewith.

It therefore is an object of the invention to overcome disadvantages associated with prior art pumps used to deliver liquefied gases.

The invention relates to a fuel supply system for a vehicle, which uses an externally-mounted positive displacement pump to supply the LPG from the storage tank to the engine. More particularly, the invention relates to a dual-acting, seal-less LPG injection pump, which is formed as a piston pump for pumping the fluid from the storage tank to the engine intake manifold. The term seal-less shall refer to a pump that has only stationary seals, and no moving or dynamic seals. In the preferred embodiment, the pump is provided in a dual-acting, single piston configuration, wherein the pump piston is driven by a pneumatic drive actuator which may be formed as a pneumatic drive cylinder or other mechanical drive mechanism that reciprocates the piston. The drive actuator is operated using the vehicle's pneumatic air system, wherein the pressurized air of this system alternatingly drives or reciprocates the pneumatic drive actuator, which in turn drives the piston. The pressure cylinder of the actuator is operatively connected to the pump piston through a seal-less connection, such that movement of one end of the drive cylinder effects a direct, corresponding movement of the piston.

As to the seal-less connection, the inventive pump uses a contained, tubular pump housing, which is formed as a thin-walled pump tube that internally defines a pump chamber. The piston is wholly contained within the elongate pump chamber wherein the piston is driven in a reciprocating manner. Preferably, the piston is dual acting so that each direction of movement defines a pumping stroke. The vehicle's air system is used to pressurize and drive the piston through both pumping strokes.

More particularly, to drivingly connect the pump piston and drive cylinder, an inner magnet set is provided on the piston within the pump chamber, and an outer magnet set is positioned outside of the pump housing adjacent the inner magnet set to form an indirect, magnetic connection through the attractive magnetic fields defined by the magnet sets.

Preferably, the tube is made from non-magnetic material, such as stainless steel, but can be constructed from any non-magnetic material. The outer magnet set is carried in a movable main body which in turn is directly connected to the drive cylinder. Reciprocation of the main body also reciprocates the piston due to the magnetic connection therebetween. Since the magnetic connection between the magnet sets requires no penetrations through the pump housing, a seal-less connection is formed between the piston and the drive actuator.

As the main body is moved in one direction, fluid is pumped out of one piston side that is being constricted, which is the outlet side, while fluid is drawn into the opposite suction side of the piston that is being expanded during piston movement, which is the inlet side. When the pneumatic actuator is reversed, pumping action within tube is also reversed, such that the inlet and outlet sides also reverse.

In another aspect of the invention, the pump outlet pressure is a direct result of the motivating input force supplied by the actuator in addition to any inlet pressure supplied to an inlet side of the piston. In the case of high inlet pressures, which can be encountered when pumping a liquefied gas supplied by a pressurized tank, the inlet pressure will assist the pump in reaching higher discharge pressures. Therefore, in the case of a pressurized inlet, a lower motivating force is necessary, which makes the pump more energy efficient.

As a result of the inventive pump design, the alternating operation of the piston generates a continuous, uninterrupted flow of the LPG discharged from the opposite ends of the pump since the piston is always moving through one piston stroke or the other.

Other objects and purposes of the invention, and variations thereof, will be apparent upon reading the following specification and inspecting the accompanying drawings.

Figure 1:
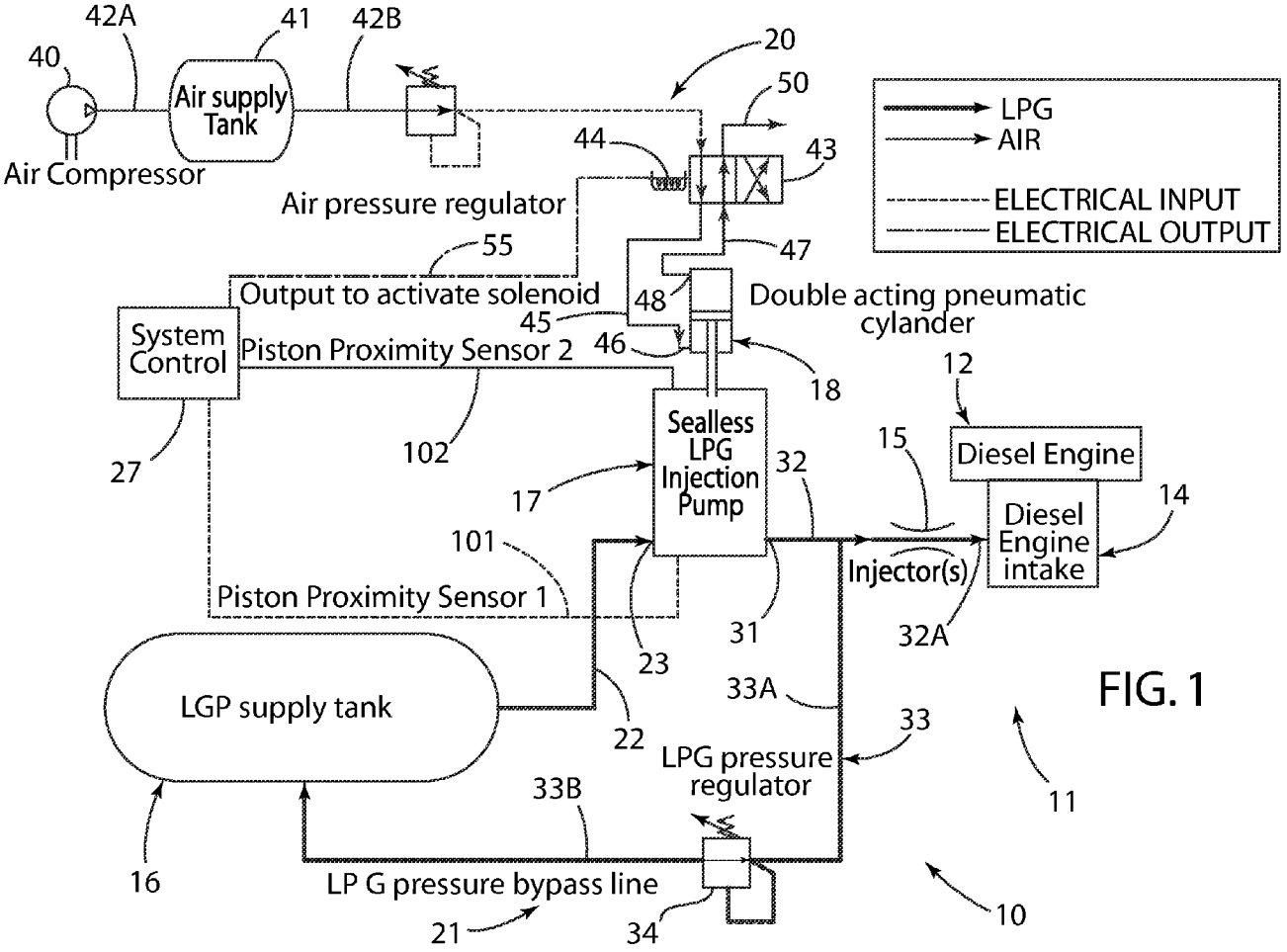
FIG. 1 diagrammatically illustrates a fuel injection system including the seal-less piston pump of the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention generally relates to a fuel supply system 10 for a vehicle which is generally designated by reference numeral 11 in FIG. 1. This vehicle 11 may be any conventional vehicle, but typically is a truck or the like in which a supplemental fuel, such as Liquefied Petroleum Gas (LPG or propane) or an LPG/Butane mix, is injected into the engine to improve performance thereof.

As to the vehicle 11, this vehicle 11 is powered by a conventional diesel engine 12, which includes a diesel engine intake 14 that may be constructed in the form of a fuel header or manifold. This engine intake 14 is supplied through one or more fuel injectors 15 wherein a representative one of such injectors 15 is illustrated in FIG. 1. For the diesel engine 12, it is known to inject the LPG into the fuel-air mixture to reduce emissions and increase engine performance. In known systems, the LPG may be pumped using an in-tank submersible turbine pump (not illustrated). The present invention relates to an improved pump configuration having a seal-less pump 17, which is used to pressurize and inject the LPG into the engine intake 14.

More particularly, a conventional vehicle may also include a supply tank 16, which is mounted to a vehicle body and is pressurized so as to store the LPG or other fuel additive therein. To deliver the injection fluid to the injectors 15 and to the engine intake 14, the inventive injection pump 17 preferably is a seal-less LPG piston pump that is pneumatically driven by a drive actuator 18 and provides a continuous supply of the injection fluid. Preferably, the drive actuator 18 is a double acting pneumatic cylinder that is connected to and operated by the air supply system 20 of the vehicle 11 as will be described in greater detail hereinafter.

While the air supply system 20 is the driving means of the pneumatic cylinder, it will be understood that the pump 17 could also be driven by other pressurized fluid sources such as an "under the hood" air compressor on the vehicle 11, a hydraulic fluid supply system driving a hydraulic actuator, or by mechanical means such as linear actuators or other mechanical actuators having a similar structure and function. The particular construction of the inventive pump 17 provides a low flow, high pressure pumping of the LPG or propane. Further, the pump 17 readily accommodates changes in environmental temperature, which can vary the pressure or psi of the propane depending upon whether environmental conditions are hot or cold.

Generally as to the inventive pump 17, the pump 17 is a dual-acting LPG injection pump, which is formed as a piston pump for pumping the fluid from the storage tank 16 to the engine intake 14. As will be described in more detail herein, the drive actuator 18 is operatively connected to the pump piston through a seal-less connection, which uses an indirect magnetic connection to translate pressure cylinder movement of the actuator 18 into piston movement within the pump 17. This provides significant advantages as will be understood from the following discussion.

Next as to the piping system connected between the supply tank 16, injection pump 17 and engine intake 14, these components are piped together in fluid communication with each other to define the supply lines for the delivery of LPG or any other process or injection fluid from the supply tank 16 to the engine intake 14. The pump 17 is particularly suitable for use with liquefied gases.

The piping system 21 also includes various system controls to control the delivery of the injection fluid. More particularly, the supply tank 16 is connected to the injection pump 17 by a first supply line 22 that is connected upstream of the injection pump 17 to an inlet 23 thereof and receives the LPG or other injection fluid therethrough.

Specifically, the supply line 22 supplies fluid to the pump 17 through inlet 23 wherein the pump 17 and actuator 18 are operatively controlled by a system controller 27, which may take the form of a PLC (Programmable Logic Controller) controlling the operation of the various mechanical components and the various system controls provided therein. The system controller 27 may take other forms, such as different types of electrical or mechanical system controllers, although most preferably, a computer-based controller is provided to generate the necessary electronic signals to drive the various controls, as will be described further herein.

When the pump 17 is in an open operative condition, the injection fluid is able to flow through the supply line 22 from the upstream supply tank 16 to the process fluid side of the downstream injection pump 17. The injection pump 17, during operation thereof, preferably draws the injection fluid through the supply line 22 and then pumps the fluid through a pump outlet 31 to another downstream supply line 32, which connects the injection pump 17 to the engine intake 14. The downstream supply line 32 exits the outlet 31 from the process fluid side of the injection pump 17 and extends to the injectors 15. The injectors 15 inject the LPG injection fluid into the engine intake 14 as diagrammatically indicated by reference arrow 32A. The injectors 15 serve to constrict the fluid flow therethrough so that the injector flow 32A essentially is pressurized and sprayed into the engine intake 14 in an appropriate condition for use by the diesel engine 12.

Preferably, the injection pump 17 pressurizes the injection fluid to generate a specific constant pressure, which pressure is used to supply the engine intake 14. To optimize operation of the diesel engine 12, the specific constant pressure should be maintained by operation of the system and excessive process fluid pressures are undesirable. In order to accommodate the possibility of excessive pressures within the supply line 32, the piping system 21 further includes a return line 33, which is fluidly connected to the supply line 32 upstream of the injectors 15. The return line 33 connects to a pressure regulator 34, which is normally closed, but opens if a pressure limit is reached and exceeded. The pressure regulator 34 therefore is connected to an upstream segment 33A of the return line 33, as well as a downstream segment 33B, which thereby defines the pressure bypass line 33. If the pressure regulator 34 encounters pressure in the upstream segment 33A which exceeds the pressure limit, the pressure bypass valve 34 then opens in response to the excessive pressure to allow the injection fluid to flow through the downstream segment 33B back to the supply tank 16. As the injection fluid flows through the bypass segment 33B, this reduces and stabilizes the line pressure to the desired specific constant pressure that is to be developed within the engine intake 14. If the excessive pressure condition continues, the pressure regulator 34 would maintain an open condition to allow excessive pressure to be relieved through the bypass line 33B. Should the pressure drop below the preset pressure limit of the pressure regulator 34, the regulator 34 is then able to close to allow pressure to build back up within the supply line 32 and be maintained at the specific constant pressure desired for the engine intake 14.

The pressure bypass valve 34 may be mechanically adjusted to set the pressure limit, although it is also possible to control the pressure regulator 34 through electronic connections and settings controlled by the system controller 27.

In one potential scenario, the system may be turned off which might result in an increase in temperature within the line 32. This condition may cause expansion of the process fluid in line 32, which in turn causes the undesirable increase in line pressure, which pressure increase preferably is relieved by the pressure regulator 34. It will also be understood that in some situations it may be desirable to eliminate the pressure bypass line 33 and the associated pressure regulator 34.

Generally as to the injection pump 17, the pump operates to supply the injection fluid through the piping system 21. In order to operate the injection pump 17, the pump 17 is connected to and is operatively driven by an actuator 18 that is driven by the air supply system 20 of the vehicle 11. Typically, the air supply system 11 is already provided on the vehicle 11 such that installation of the injection pump 17 does not require substantial changes to the vehicle systems.

The air supply system 20 illustrated in FIG. 1 is preferably driven by a fluid pressurization device and most preferably an air compressor 40 which pressurizes an air supply tank 41 through an air line 42A. The air supply tank 41 functions as a reservoir for storing a bulk volume of pressurized air, which volume of pressurized air is recharged through operation of the air compressor 40. The air is directed downstream from the tank 41 through a supply line 42B that connects to a four-way control valve 43. The control valve 43 is actuated by a solenoid 44 for switching of the valve 43 between first and second operative conditions. A feed line 45 is connected between the valve 43 and a first connection or port 46 on the actuator 18. Additionally, the valve 43 is also connected through a second feed line 47 to a second connection or port 48 on the actuator 18.

Still further, the valve 43 connects to a discharge line 50 which can vent to atmosphere. When the control valve 43 is in the first operative condition, as diagrammatically shown in FIG. 1, the air supply line 42B is connected to the feed line 45 which in turn supplies pressurized air to the actuator 18 for operating injection pump 17 in a first direction of piston movement. The second feed line 47 passes through the valve 43 and connects to the discharge line 50 to allow air to be discharged from the actuator 18 for discharge to atmosphere. The four-way valve 43 also is moveable by the solenoid 44 to the second operative position represented on the right side thereof wherein the air supply line 42B then connects to the feed line 47, while the other feed line 45 connects to the discharge line 50 for the discharge of air therethrough. This reverses the actuator 18 and operates the pump 17 in a second direction of piston movement. Hence, the valve 43 alternatingly supplies air to the actuator 18 through either the connector port 46 or connector port 48 while the other of the connector ports 46 or 48 is connected to the discharge line 50. Switching of the valve 43 by the solenoid 44 then reverses the connections and reciprocates the actuator 18.

Operation of the valve 43 is effected by the system controller 27 through a control line 55, which serves as an output from the system controller 27 in order to selectively activate the solenoid 44. Accordingly, the system controller 27 is able to control switching of the valve 43 between the first and second operative positions and thereby control reciprocal operation of the actuator 18.

Figure 2:
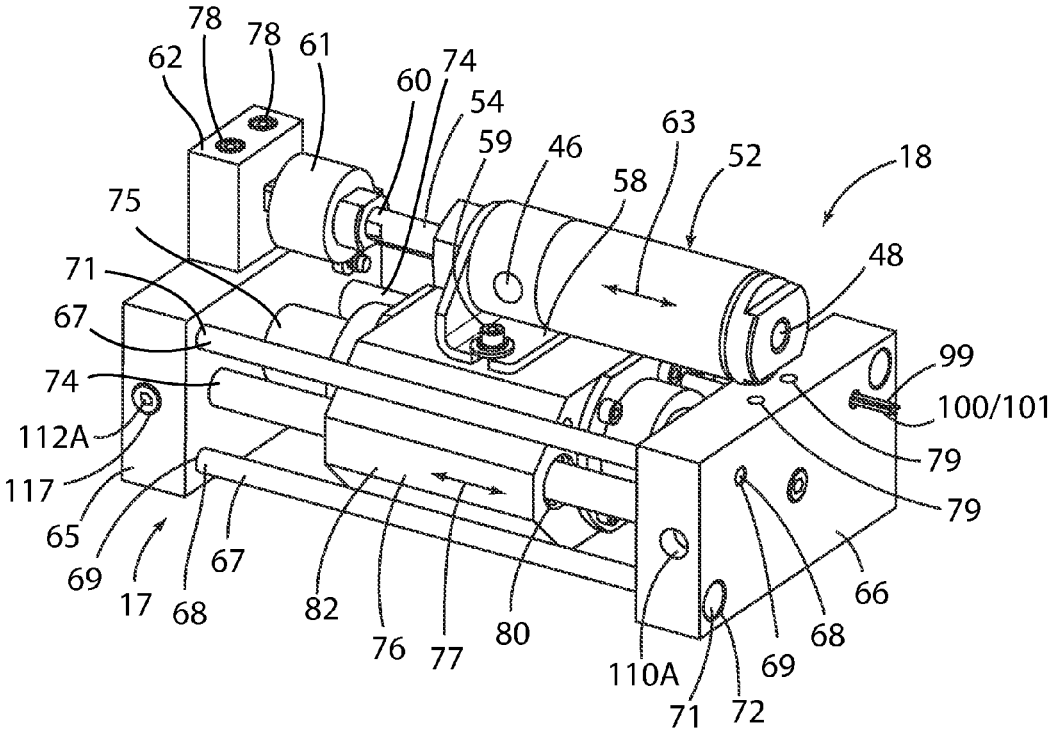
FIG. 2 is an isometric view of the pump.
Figure 3:
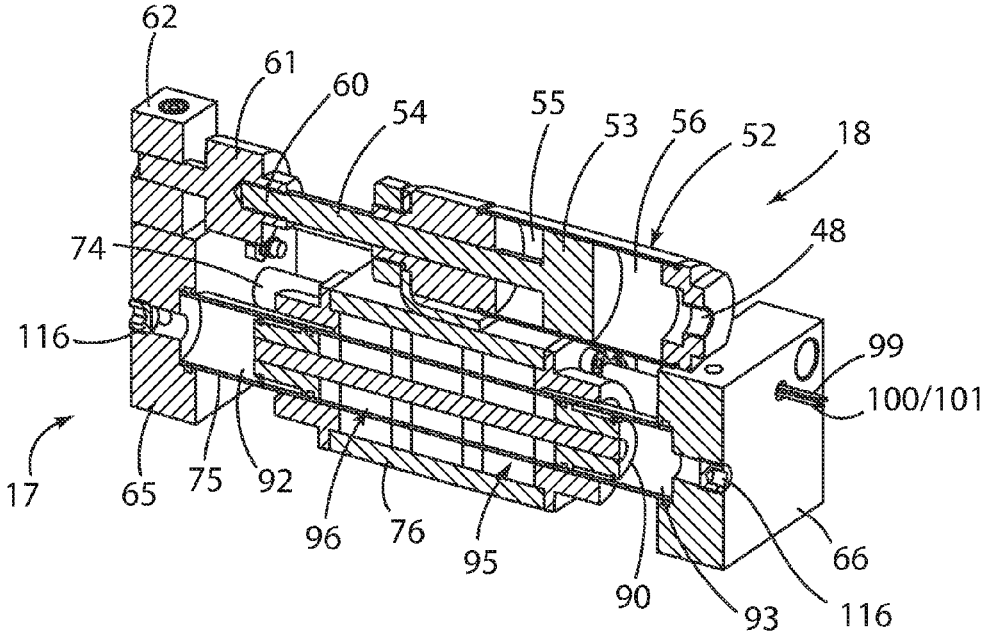
FIG. 3 is an isometric cross-sectional view from a first side of the pump showing the internal components thereof in a first operative condition.
Figure 4:
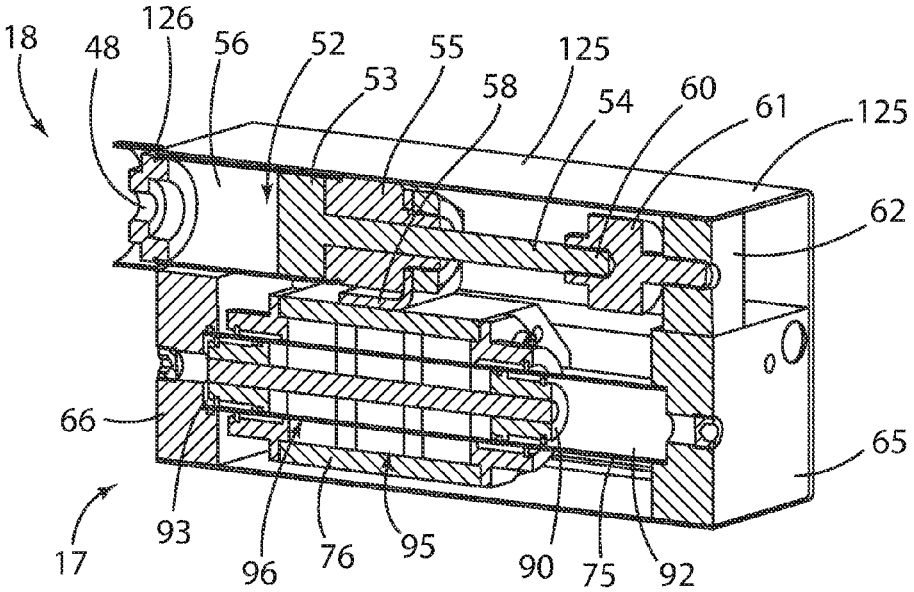
FIG. 4 is a side cross-sectional view as taken from the opposite second side of the pump showing an actuator in a second operative condition.

Turning next to FIGS. 2-4, the injection pump 17 is illustrated separately from the remaining system components described relative to FIG. 1. Generally, the injection pump 17 is formed as a dual-acting piston pump that functions as a positive displacement pump that is mounted on the vehicle external to the LPG supply tank 16. The pump 17 is operated using the vehicle's pneumatic air system 20 wherein the pressurized air of this system reciprocates the actuator 18 and the pump 17 wherein the pumping occurs in both directions of the pump stroke to generate a continuous flow of process fluid to the injector(s) 15.

As seen in FIGS. 2-4, the actuator 18 and pump 17 preferably are formed as an assembled unit. The illustrated actuator 18 is a commercially available double acting pneumatically actuated air cylinder. The actuator 18 comprises a cylinder 52, which slidably supports a piston 53 therein in a conventional manner. A piston rod 54 projects outwardly of the cylinder 52 and reciprocates as it moves through its instroke and outstroke. The piston 53 separates the cylinder 52 into two piston chambers 55 and 56 which chambers are in fluid communication with the supply lines 45 and 47 (FIG. 1) through the connector ports 46 and 48 (FIG. 2). As described above relative to FIG. 1, the control valve 43 is operated to alternate inlet and outlet flows of air through the supply lines 45 and 47. This either pressurizes the piston chamber 55 to move the piston 53 through the instroke, or pressurize piston chamber 56 to move the piston through the outstroke.

The cylinder 52 includes a mounting bracket 58 which is configured to be fixed to the pump 17 by fasteners 59 (FIG. 2). The outer free end 60 of the rod 54 is connected to a stationary alignment coupling 61, which is non-movably mounted to a support flange 62 that projects upwardly from the pump 17. The free rod end 60 therefore remains stationary during operation while the cylinder 52 is free to reciprocate during the instroke and outstroke of the piston rod 54. This linear cylinder movement is identified by reference numeral 63 in FIG. 2.

Figure 9:
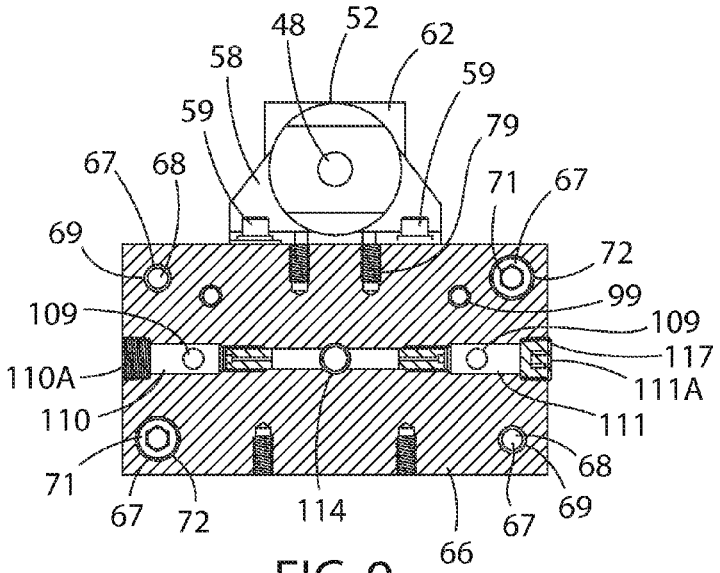
FIG. 9 is a cross-sectional end view of the pump as cut through one end cap.

As to the pump 17, the pump 17 includes a pair of end caps 65 and 66, which are axially spaced apart and joined in fixed relation to each other by four connector members 67, preferably formed as elongate bolts or cap screws. Two of the connector members 67 are best seen at two of the corners of the end caps 65 and 66. The other two connector members 67 are on the back side of the pump 17 in FIG. 2 and are generally hidden from view. Each connector member 67 has a threaded end 68, which is threaded into a corresponding threaded bore 69 of one of the end caps 65 and 66, and a head end 71, which fits into a socket 72 in the other of the end caps 65 and 66. These structures also can be seen in FIG. 9. In this manner, the end caps 65 and 66 are rigidly connected in axially spaced relation wherein the connector members 67 serve as frame structure for the pump 17 and also protect the interior components of the pump 17.

Generally as to FIG. 2, the end caps 65 and 66 support two guide tubes 74 and a central, tubular pump housing or pump tube 75. These components will be described in further detail below. Further, a main pump body 76 is slidably supported on the guide tubes 74 so that the main body 76 can be supported thereon and reciprocates along the guide tubes 74 and pump tube 75 as indicated by reference arrow 77 in FIG. 2.

The above-described support flange 62 is mounted on the one end cap 65 by bolts 78, which engage bolt holes 79 (as seen on end cap 66). The end cap 65 rigidly supports the piston rod end 60 by the support flange 62. The piston mounting bracket 58 in turn is affixed to the main pump body 76 by the bolts 59 so that reciprocating movement of the drive cylinder 52 along path 63 causes the main body 76 to reciprocate along path 77. This movement of the main body 76 causes dual action pumping as will be described below. Since the cylinder 52 moves axially past the end cap 66, only the one end cap 65 has the support flange 62 to provide clearance for cylinder 52.

Figure 8:
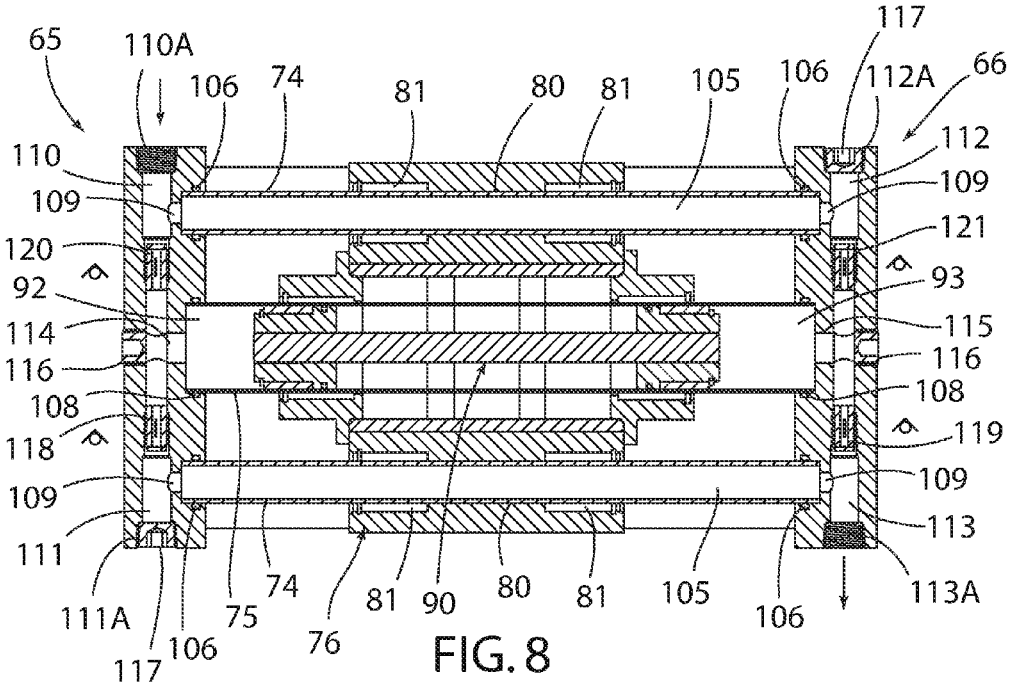
FIG. 8 is a cross-sectional plan view of the pump as cut through both guide tubes.

As seen in FIG. 8, the main body 76 includes side sections which define elongate guide bores 80 through which the guide tubes 74 extend. Tubular bearings 81 are provided to slidably support the main body 76 on the guide tubes 74 while reducing friction therebetween.

Figure 5:
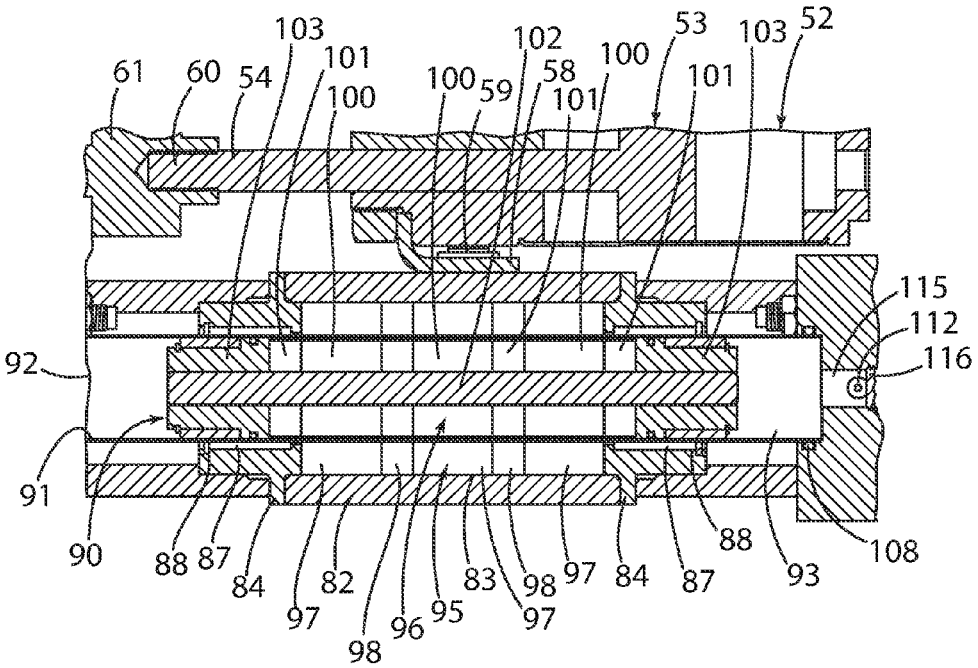
FIG. 5 is an enlarged cross-sectional view of the piston and drive assemblies.
Figure 6:
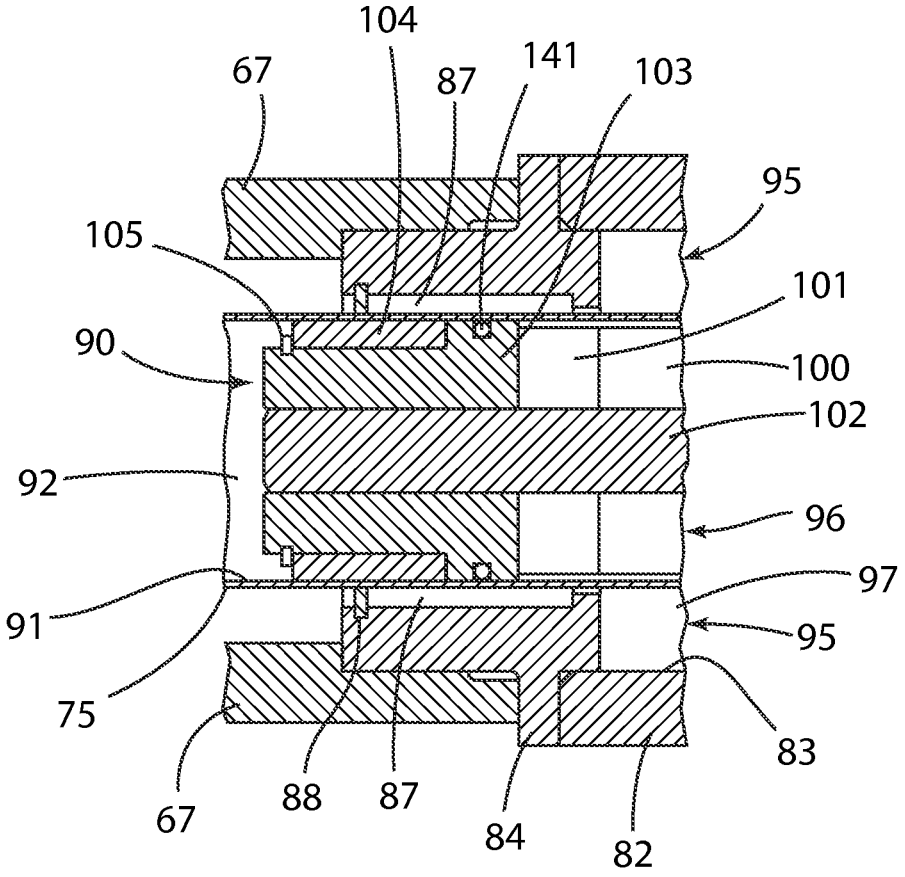
FIG. 6 is an enlarged cross-sectional view of one end of the piston assembly.

Referring to FIGS. 5 and 6, the main body 76 is formed as an assembly from an outer housing 82 that defines an interior chamber 83, and from two outer housing end caps 84, which enclose the opposite ends of the interior chamber 83. The end caps 84 each include tubular guide bushings 87, which are slidably along the outer surface of the pump tube 75. An annular gasket-like dust seal 88 is provided next to each guide bushing 87 wherein the dust seal 88 slidingly contacts the pump tube 75 to keep contamination out of interior chamber 83. As such, the main body 76 is able to slide along the guide tubes 74 and pump tube 75 in response to reciprocation of the cylinder 52.

As referenced above, the pump 17 essentially is a seal-less piston pump. Generally, the pump 17 includes a dual-acting piston 90, which is slidably received within the pump tube 75 and effects pumping of the injection fluid. The piston sub-divides the interior pump bore 91 of the pump tube 75 into first and second pump chambers 92 and 93.

To effect reciprocation of the piston 90, an indirect, magnetic connection is formed between the main body 76 located exteriorly of the pump tube 75 and the piston 90 located within the interior bore 91 of the pump tube 75. To form this magnetic connection, the main body 76 includes an outer magnet set 95 and the piston 90 includes an inner magnet set 96, which magnetically attract each other through the thin wall of the pump tube 75. The pump tube 75 is preferably formed of a non-magnetic, durable material such as stainless steel. As the main body 76 reciprocates the magnetic interaction and attractive force between the outer and inner magnet sets 95 and 96 drive the piston 90 in unison with the main body 75 to effect pumping of the injection fluid.

The outer magnet set 95 comprises an alternating stack of multiple annular magnets 97 and annular spacers 98, which are slid within the interior chamber 83. The end caps 84 are affixed to the outer housing 82 by fasteners to close off and seal the interior chamber 83 from outside contaminants and dust. If desired, an axial spring may be provided within the chamber 83 to bias the outer magnets 97 tightly together in assembly.

Since the connection between the main body 76 and the piston 90 is accomplished magnetically, there are no wall penetrations of the pump tube 75 needed for the connection with the actuator 18. Since there are no wall penetrations needed for the actuator 18 to drive the piston 90, there are no dynamic seals required between moving parts which thereby makes the pump 17 a seal-less pump. This eliminates the need for secondary seals which would otherwise be required if an actuator required a direct connection to a piston within a pump chamber. Such secondary seals can create problems if the secondary seal fails and flammable injector fluid is able to escape from a pump chamber.

Next, the piston 90 is discussed in greater detail relative to FIGS. 5 and 6. The piston 90 comprises the inner magnet set 96 which comprises a stack of annular magnets 100 alternately provided with spacers 101.

When coupled with the outer magnet set 95, a large axial force is required to separate the inner magnet set 96 from the outer magnet set 95. This is the primary driving force needed to pump fluid at elevated pressure. However, the maximum differential pressure also can be limited by the magnet holding power of the magnet sets 95 and 96. When differential pressure on the pumping side in comparison to the drive side exceeds the holding power of magnets 97 and 100, the inner and outer magnet sets 95 and 96 can decouple without damaging the pump components. The outer magnet set 95 and main body 76 will continue to move past the piston 90 but can recouple with the piston 90 on the return stroke. As such, if the system returns to lower pressure, the magnet sets 95 and 96 can be recoupled and the pump 17 restarted. This is an inherent safety feature;

The magnets 100 and spacers 101 extend along a threaded stud 102, which includes piston end caps 103 fastened to the opposite ends thereof. The stud 102 axially joins the spacers 101, inner magnets 100 and end caps 103 together in a cohesive unit that moves together during pump operation.

The piston 90 axially separates the pump chambers 92 and 93 from each other. The end caps 103 include piston guide bushings 104, which are restrained axially by retainers 105 and locate the piston 90 within the inner bore 91 of the pump tube 75. Further, annular gaskets or seals 141 are provided in contact with the inner bore 91 so as to prevent axial leakage or migration of injector fluid between the pump chambers 92 and 93 that are alternatingly being filled and pumped out during reciprocation of the piston 90. Essentially, the seals 141 keep product on the high pressure side of the piston 90 from migrating to the low pressure side of piston 90.

Therefore, in operation, the piston 90 subdivides the inner bore 91 into pump chambers 92 and 93, wherein the chamber volumes increase and decrease as the piston 90 reciprocates. FIG. 3 shows an intermediate position for the piston 90 while FIG. 4 shows the piston moved to a second position at one end of a pumping stroke. In this position, the piston 90 decreases the volume of the pump chamber 93 to pump fluid out of such chamber 93 and increases the volume of the pump chamber 92 to draw injector fluid into chamber 92. When the main body 76 and cylinder 52 reverse directions, the pump chamber 93 increases to draw in fluid, and chamber 92 decreases to pump out fluid. FIG. 4 shows one stroke limit and the opposite end of pump tube 75 represents the opposite stroke limit. Hence, in both stroke directions, the piston 90 is always pumping the fluid out of one chamber 92/93 or the other. This provides for a continuous supply of injector fluid, which exits the pump outlet 31 (FIG. 1).

Figure 7:
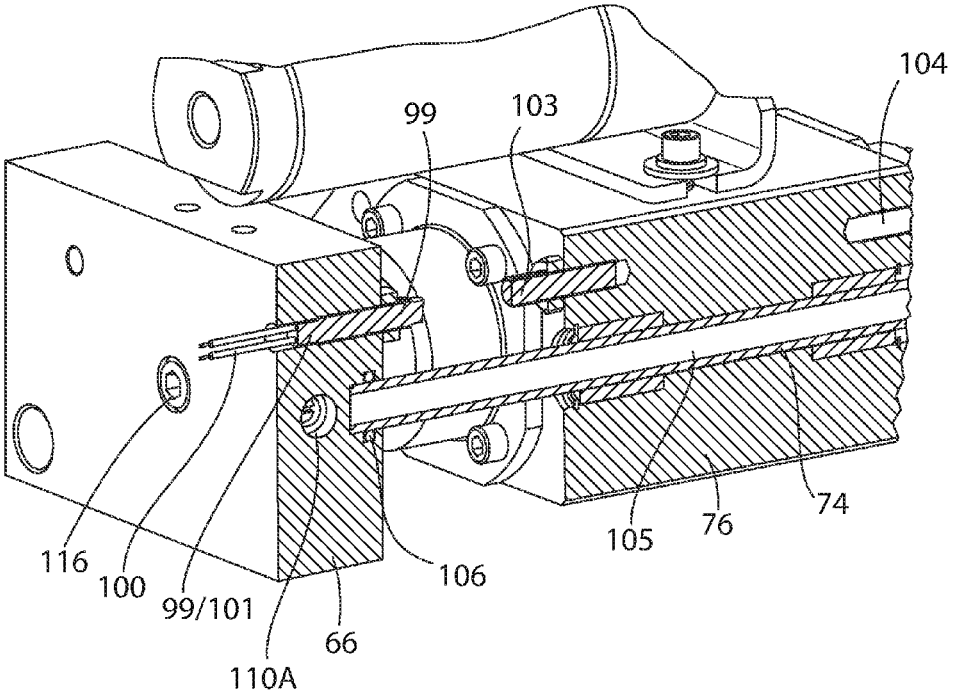
FIG. 7 is a partial cross-sectional view of the pump as cut along one guide tube.

Referring to FIG. 7, to determine when to reverse the stroke direction of the piston 90, a proximity sensor 99 senses when the piston 90 is at an end of stroke. A proximity sensor 99 is provided in each of the end caps 65 and 66 and has sensor wires 100 which connect to the signal lines 101 and 102 shown in FIG. 1. The signal provided by sensors 99 is used by the system controller 27 to switch the direction of main body 76 by operation of the valve 43 (FIG. 1). Each of the sensors 99 senses a metallic insert or plug 103 and 104 mounted at opposite ends of the main body 76 for generating signals in lines 101 and 102.

To control the time at which the valve 43 switches between the first and second operative conditions, proximity sensors 99 are able to detect the main body 76 as it approaches the sensor 99 through interaction with the inserts 103 or 104. In one example, each of the metallic insert or plugs 103 and 104 preferably is formed as a magnet and is detected as they approach one proximity sensor 99 or the other to trip the proximity switch therein. In this regard, the sensor 99 may be of the type, such as a Reed switch, that detects the presence of magnetic body when the main body 76 and sensor 99 are close together, for example, as seen in FIG. 4, wherein the main body 76 is disposed in close adjacent relationship to the sensor 99 on end cap 66. Theses sensor inserts 103 and 104 seat within respective sensor bores in the main body 76 as seen in FIG. 7.

While the proximity sensors are illustrated as a preferred embodiment for reversing the movement of the piston 90, other sensing or control means may be used to reciprocate these piston 90. In one example, the system controller 27 may simply control the solenoid 44 using a timing signal or circuit wherein the valve 43 may be switched between its operative conditions after preselected time periods which are calculated based upon the time that the piston 90 reciprocates through its pumping strokes. Preferably, the time period as selected serves to limit or prevent bottoming out of the piston 90 against one end cap 65/66 or the other. Other methods may be used to determine the time or location at which the piston stroke should be reversed. For example, it also may be desirable to monitor the discharge pressure in line 32, which would indicate when the piston 90 bottoms out wherein detection of a pressure drop in such line 32 would indicate that the piston 90 had reached the end of its pumping stroke.

As seen in FIG. 7, the sensor 99 in the illustrated position is ready to detect the insert 103 on main body 76, which will provide a signal through sensor line 101 to the system controller 27. The system controller 27 in turn sends a control signal through control line 55 to the solenoid 44 which in turn switches the valve 43 between the first operative position shown in FIG. 1 to the second operative position described above. Upon the switching of the valve 43, the supply of pressurized air to the connector 46 is discontinued and this connector 46 is then allowed to discharge through discharge line 50 with the valve 43 in the second operative position. In this condition, the pressurized air is then supplied from line 42B to line 47 which supplies the pressurized air to the connector 48 and cylinder 52. This now drives the interconnected cylinder 52, main body 76 and piston 90 through one pumping stroke which continues until its respective sensor 99 detects the presence of the other insert 104 which then causes the next successive switching of the valve 43 to then depressurize piston chamber 56 of air cylinder 52 and re-pressurize piston chamber 55. In this manner, the system controller 27 controls reciprocation of the piston 90.

Keeping in mind the operation of the piston 90, the following disclosure relates to the inlet and outlet paths defined through the pump 17.

As noted above, the guide tubes 74 provide a first function of guiding and supporting the main body 76. However, as seen in FIGS. 7 and 8, the guide tubes 74 also are hollow and perform a second function of defining a fluid flow path 105, which forms part of the inflow and outflow paths for the injector fluid being pumped through the pump 17. Structurally, the opposite ends of the guide tubes 74 seat within bores formed within the end caps 65 and 66 and are sealed therein by annular seals 106. These guide tubes 74 are accurately positioned to guide the main body 76 and support loads from both the pneumatic actuator 18 and reactionary forces from piston 90, which act axially along the guide tubes 74.

The pump tube 75 is similarly mounted within bores formed in the end caps 65 and 66 and are sealed therein by annular gaskets or seals 108. During assembly, the guide tubes 74 and pump tube 75 are restrained axially within such end cap bores by installation of the connector members 67 described above. The connectors 67 are formed as bolts which tightly draw the end caps 65 and 66, guide tubes 74 and pump tube 75 axially together to prevent any leakage from the hollow passages formed within the tubes 74 and 75. Notably, there is no relative motion between the tubes 74/75 and the end caps 65 and 66 during pump operation, such that the seals 106 and 108 are static seals that are much less prone to leakage in comparison to dynamic seals. As described above, this pump 17 is a seal-less pump in that it does not require any moving parts which project into the pump chamber and which require dynamic seals.

More particularly as to the flow passages, the tube passages 105 open into axial bores 109 that open through the sides of transverse passages 110, 111, 112, and 113. The transverse passages 110, 111, 112, and 113 are formed through the end caps 65 and 66 and open through respective ports 110A, 111A, 112A, and 113A. In addition, chamber ports 114 and 115 open respectively into pump chambers 92 and 93, as well as the passages 110/111 and passages 112/113. The chamber ports 114 and 115 are formed by boring into the end caps 65 and 66 respectively, which bores are then closed by plugs 116. All of these passages and ports are constructed so as to be in fluid communication with each other. However, flow control devices are inserted into the passages to selectively control flow therethrough during piston operation and provide for a continuous outflow of injector fluid from the pump 17 during reverse movement of the piston 90.

In more detail, the port 110A can be selected as the inlet port 23 and any one of the other ports such as port 113A can be selected as the outlet port 31. These functions could be changed if desired, since the overall fluid flow through the ports and passages depends upon the flow control devices.

Where the two ports are selected as the inlet and outlet (such as ports 110A and 113A), the other two ports would then be closed by threaded plugs 117. Before installing plugs 117, appropriate check valves are installed in each of the passages 110, 111, 112, and 113, which check valves would include two check valves 118 and 119 on the outlet side and two check valves 120 and 121 on the inlet side. The check valves open and close in dependence on the pump chambers 92 and 93, which generate high pressure during pumping that is greater than the inlet and outlet pressures.

The inlet check valves 120 and 121 open to permit one-way in-flow of the LPG process fluid into the piston chambers 92 and 93 during suction, but automatically close when pressurized to prevent discharge or out-flow of any process fluid from the piston chambers 92 and 93. Hence, when the piston moves to the right in FIG. 8, pump chamber 93 is pressurized which opens valve 119 and closes valve 121 to discharge fluid through outlet 113A. The other outlet valve 118 closes when the pump chamber 92 is subject to suction while inlet valve 120 opens to permit fluid flow from inlet 110A. When the piston 90 moves to the left in FIG. 8, pump chamber 92 then is pressurized which opens outlet valve 118 and closes inlet valve 120 to discharge fluid through outlet 113A using the guide tube passage 105. The other outlet valve 119 closes when the pump chamber 93 is subject to suction while inlet valve 121 opens to permit fluid flow from inlet 110A through the other guide tube passage 105.

Hence, as the piston 90 reciprocates through its dual action pumping strokes, this will generate a continuous flow of fluid through the outlet port 113A by opening either of the outlet check valves 118 or 119 so that the process fluid can flow through the outlet passage 113A to the supply line 32 for subsequent injection into the engine intake 14 described above. During this time, one or the other inlet check valves 120 or 121 opens such that the other of the pumping chambers 92 and 93 is refilling to allow continuous refilling of the other of the pump chambers 92 and 93. In this manner, the reciprocating movement of the piston 90 effects simultaneous refilling and pumping through the respective inlet port 110A and outlet passage 113A. This therefore provides a continuous low flow, high pressure supply of fuel additive, which is supplied through the supply line 32 to the engine intake 14.

Since the end caps 65 and 66 are bored out to form these passages, this allows for a small pump package and simplified plumbing for customer interface.

It will be understood that the outlet pressure from outlet port 113A is a direct result of the motivating input force from the actuator 18 (which may be a pneumatic actuator, hydraulic actuator, mechanical actuator or the like) in addition to inlet pressure received through inlet port 110A. In the case of a high inlet pressure, which would occur with a liquefied gas supplied by the pressurized tank 16, the inlet pressure will assist the pump 17 in reaching higher discharge pressures since the inlet pressure helps motivate the piston 90. Therefore, in the case of a pressurized inlet, a lower motivating force by the actuator 18 is necessary, which makes the pump 17 more energy efficient. Additionally, it is preferred that the system controller 27 monitor the pressure on the outlet 113A, which allows the controller to control the air pressure being provided to the cylinder 52 and thereby modify the motivating force provided thereby to control the outlet pressure.

Referring back to FIG. 4, the pump assembly also includes a guard or enclosure 125, which protects users from potential injury, and protects the pump components from the elements. One end of the guard 125 may include an opening 126 to accommodate axial movement of the cylinder 52.

Based upon the foregoing, the present invention provides significant advantages. The pump 17 and actuator 18 are connected indirectly by a non-mechanical connection and most preferably, by a magnetic connection. This allows the pump 17 to be driven pneumatically, hydraulically, or mechanically, such as by a screw/gear drive provided in place of the air cylinder, and yet the a seal-less axial piston pump 17 has no dynamic seal between atmosphere and product. As such, this inventive design is safer than pumps using dynamic seals since there are no dynamic seals to wear out and fail causing leakage of potentially dangerous products.

If the internal seals 141 actually do fail, this will simply allow leakage or cross flow between the pump chambers 92 and 93 but there will be no leakage outside of the pump 17. The pump 17 may cease to operate effectively or will operate at a reduced capacity but the failure of seals 141 will not cause potentially hazardous leakage to atmosphere.

This design also allows for easy replacement of drive components since the dual acting axial actuators 18 are readily and commercially available.

In a further aspect of the invention, the guide tubes 74 are used as both a locating feature and for internal fluid movement. This makes the pump package smaller and allows for a simpler customer interface (one inlet, one outlet).

Further, the discharge or outlet pressure is a result of a combination of the inlet pressure and the motivating force of the actuator 18. Discharge pressure can be monitored and used to vary the air/hydraulic pressure driving actuator 18 to maintain constant system pressure. This could reduce energy needed to maintain constant system pressure in applications using a pressurized inlet.

The modular construction offers many options including:

Use of a wide range of materials necessary for pumping a wide range of fluids;

Low weight materials in areas not sensitive to wear;

Tube length of pump tube 75 could be changed to easily increase or decrease pump displacement;

Pump discharge pressure is controlled by the air pressure provided to the pneumatic actuator 18 (or hydraulic pressure to a hydraulic actuator). This is inherently safer than relief valves although a hydrostatic relief valve may still be required in closed systems to prevent system overpressure when heated.

The structure of the system wherein the mounting bolts 67 are outside of the guide tubes 74 and pump tube 75 provides rigidity and protects pressure containing elements from physical damage;

The structure also allows for simplified guarding against pinch points for operator/technician safety during maintenance since all sliding components are buried within the pump frame;

The maximum differential pressure can be limited by magnet holding power of the magnet sets 95 and 96. When differential pressure exceeds the holding power of magnets 97 and 100, the inner and outer magnet sets 95 and 96 can decouple. If the system returns to lower pressure, the magnet sets 95 and 96 can be recoupled and the pump 17 restarted. This is an inherent safety feature;

Relative slow moving fluid and the large surface area of guide tubes 74 could be used in conjunction with pump tube 75 to either heat or cool the fluid;

The pneumatic actuator size could be used to control maximum pressure generated by the piston 90. As an example, it will be noted that the injection pump 17 governs or dictates the outlet pressure in line 32 by the construction of the piston area and the piston stroke length.

Further, the above design provides an improved ability to refurbish the pump 17. In this regard, the end caps 65 and 66 can be readily removed to allow for replacement of the various tubes, seals, check valves and other components.

Next, the modular construction also allows for alternate configurations of pumps.

The pump 17 could also be constructed of multiple tubes, bodies, or pistons to allow for higher flow rate or plumbed in series for higher overall differential pressure capability. The pumping system of the present invention lends itself to be configured for high pressure, and very low flow applications.

Figure 10:
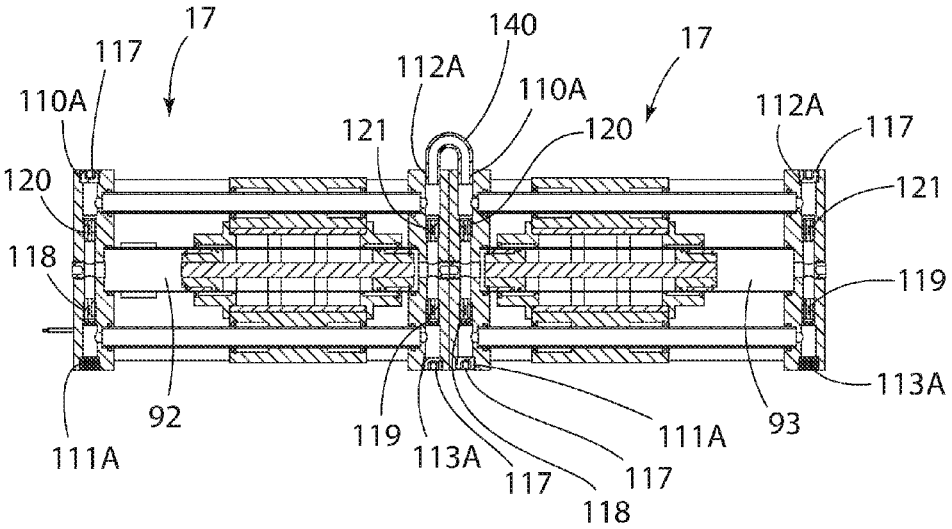
FIG. 10 is cross-sectional plan view similar to FIG. 8 showing a second embodiment of the invention comprising two inventive pumps connected in series.
Figure 11:
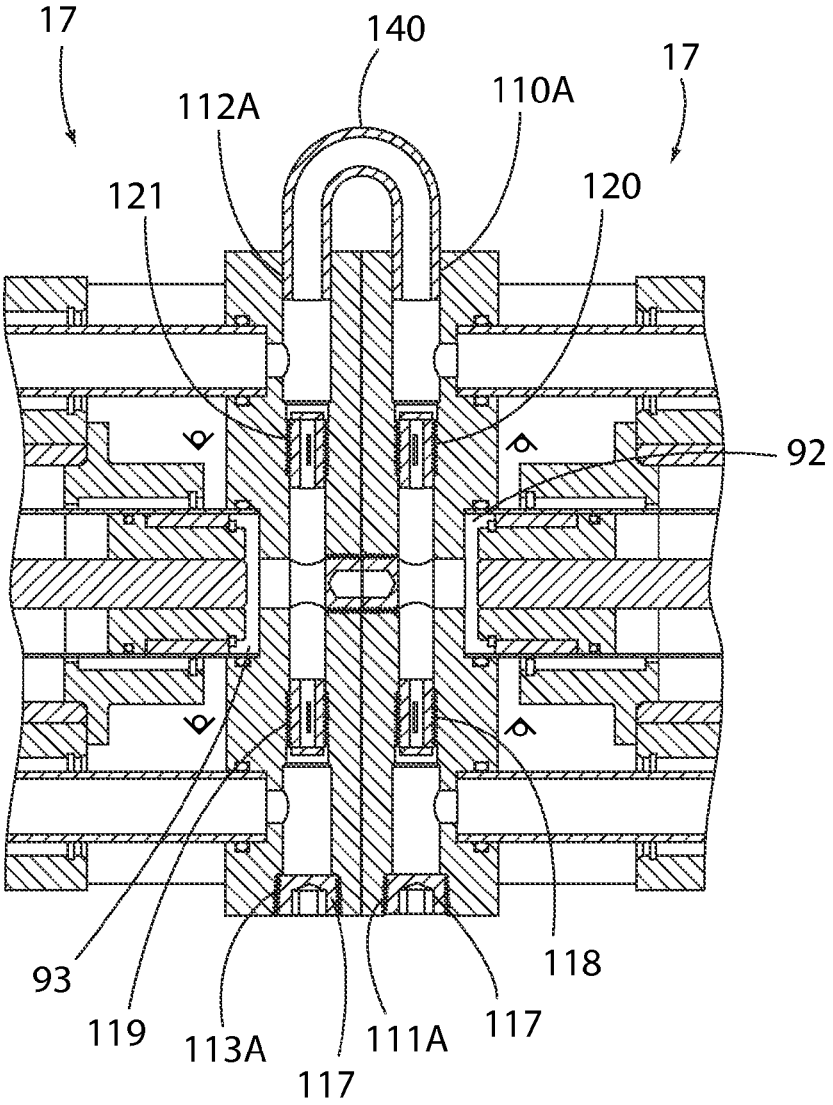
FIG. 11 is an enlarged cross-sectional plan view of FIG. 11 showing the series-connected pumps.

For example, referring to FIGS. 10 and 11, a further embodiment of the invention is illustrated. This system is similar in many respects to the system illustrated in FIG. 1, and as such, common reference numerals are used for common components already described above. The use of the same reference numerals indicates that the structure and function of these components are the same and as such, further discussion of the system components is not repeated herein relative to FIGS. 10 and 11. The following discussion therefore is directed to the differences in the systems of FIGS. 1 and 10-11.

In this design, two pumps 17 are provided in series. These pumps 17 are constructed virtually the same as the pump 17 illustrated in FIGS. 1-9. However, the ports 111A, 112A, 113A and 114A are configured in a modified form to allow for serial operation of the pumps 17. In this configuration, the left pump 17 has the port 111A serving as an inlet, ports 110A and 113A blocked by plugs 117, and port 112A connected to the right pump by a connector pipe 140. The connector pipe 140 exits the left pump 17 and enters the right pump 17 at port 110A.

In the right pump, the ports 111A and 112A are blocked by plugs 117, while port 113A serves as the system outlet. In the left pump 17, the inlet check valves 118 and 119 close when their respective pump chambers 92 and 93 are pressurized and the other outlet check valves 120 and 121 would then open to allow fluid flow from port 112A of the left pump 17 to port 110A of the right pump 17. In the right pump 17, the inlet valves 120 and 121 would then supply the pump chambers 92 and 93 but close when their respective chambers 92 and 93 are pressurized. The outlet check valves 118 and 119 in the right pump 17 then open to allow discharge of fluid from outlet port 113A. This modified design allows the pumps 17 to be connected in series and thereby increase the total pressure of the fluid discharged from outlet port 113A.

In other alternate designs, the actuator 18 could be a screw drive instead of pneumatics/hydraulics for precise position control, rate of flow, and discharge pressure.

While the pump 17 preferably is dual acting, it will be understood these components could be modified to form a single acting pump. In this regard, the piston 90 could act in one direction by replacing the check valves in the end caps 65 and 66 with a single check valve within the inner piston 90. This would reduce number of check valves but would eliminate the benefit of lower pulsations due to the dual pumping action and would effectively lower the overall flow rate.

Although particular preferred embodiments of the invention have been disclosed in detail for illustrative purposes, it will be recognized that variations or modifications of the disclosed apparatus, including the rearrangement of parts, lie within the scope of the present invention.

What is claimed:

1. A piston pump for a fluid, comprising:

a housing unit comprising an enclosed, tubular pump housing, which is formed as a pump tube having a tube wall that internally defines an inner pump bore;

a piston wholly contained within said inner pump bore wherein said piston subdivides said inner pump bore into first and second piston chambers, said piston being reversibly movable within said inner pump bore in a reversible pumping direction so as to alternatingly expand and contract respective first and second volumes of said first and second piston chambers during piston movement;

a main body located outside of said pump housing, wherein said main body is reversibly movable along said pump housing and is magnetically coupled to said piston through said tube wall solely by a magnetic attraction between said main body and said piston, a drive actuator located on said housing unit externally of said pump housing, said drive actuator being operatively connected to said main body to effect reciprocating movement of said main body along said pump housing with said piston moving with said main body within said inner bore to vary said respective first and second volumes; and said housing unit including inlet and outlet passages for supplying an inlet fluid to an expanding one of said first and second pump chambers and receiving a pressurized fluid from a contracting one of said first and second pump chambers, said housing unit including first and second end caps which include pump housing bores that sealingly seat opposite ends of said pump housing therein, said first and second end caps including said inlet and outlet passages therein which communicate with said first and second pump chambers through said pump housing bores, said housing unit including a plurality of guide tubes extending along and parallel to said pump tube, said main body being slidably supported on said guide tubes so as to reciprocate along said pump tube and said guide tubes having opposite ends seated within guide tube bores formed in said end caps, said guide tubes being hollow and disposed in fluid communication with said said inlet and outlet passages.

2. The piston pump according to claim 1, wherein said piston pump is a dual-acting piston pump which continuously pumps the fluid, wherein said inlet and outlet passages are respectively connected to said first and second pump chambers as said piston moves in a first direction to expand said first volume and contract said second volume, and are respectively connected to said second and first pump chambers as said piston moves in an opposite second direction to contract said first volume and expand said second volume.

3. The piston pump according to claim 1, wherein said main body and said piston include magnetically attracted bodies which define a magnetic connection between said main body and said piston through said tube wall.

4. The piston pump according to claim 3, wherein said magnetically attracted bodies comprise an outer magnet set supported on said main body and an inner magnet set supported on said piston.

5. The piston pump according to claim 4, wherein said inner and outer magnet sets each comprise an alternating stack of magnets separated by spacers.

6. The piston pump according to claim 1, wherein said main body and said piston include magnetically attracted bodies which define a magnetic connection resulting from an attractive force between said main body and said piston so that said piston is driven by movement of said main body, said magnetic connection being decoupled if a fluid pressure impeding movement of said piston exceeds said attractive force.

7. The piston pump according to claim 6, wherein said magnetic connection permits said main body to be movable past said piston when decoupled, and wherein when said decoupled main body reverses direction, said magnetic connection recouples said main body with said piston.

8. The piston pump according to claim 1, wherein said housing unit includes connectors axially joining said end caps together to confine said hollow guide tubes and said pump housing axially between said end caps.

9. The piston pump according to claim 8, wherein said hollow guide tubes have said opposite ends sealingly seated within said guide tube bores in said end caps.

10. The piston pump according to claim 1, wherein said inlet and outlet passages comprise an inlet port and an outlet port each defined on a respective one of said first and second end caps, said inlet and outlet passages including flow control devices which alternatingly connect said inlet and outlet ports to either said first and second pump chambers or said second and first pump chambers depending upon said pumping direction of said piston.

11. The piston pump according to claim 1, wherein said drive actuator is a telescoping drive cylinder having a cylinder and extendible rod, and wherein said telescoping drive cylinder cylinder has one stationary end section supported on said housing unit and another movable end section drivingly connected to said main body.

12. A piston pump for a fluid, comprising:

a housing unit comprising an enclosed, tubular pump housing, which is formed as a non-magnetic pump tube having a tube wall that internally defines an inner pump bore having opposite open ends, and a plurality of elongate guide members extending along and substantially parallel to said pump tube, said housing unit further including axially-spaced, end caps which include pump tube bores and guide member bores that receive opposite ends of said pump tube and said guide members such that said pump tube and said guide members are confined axially between said end caps, said pump tube bores including gaskets for sealing said opposite ends of said inner pump bore;

a piston contained within said inner bore wherein said piston subdivides said inner bore into first and second piston chambers, said piston being reversibly movable within said inner bore in a reversible pumping direction so as to alternatingly expand and contract respective first and second volumes of said first and second piston chambers during piston movement;

a main body slidably supported on said guide members so as to reciprocate along an exterior of said pump tube, said main body being reversibly movable along said guide members and being magnetically coupled to said piston solely by a magnetic attraction between said main body and said piston acting through said tube wall;

a drive actuator located on said housing unit externally of said pump housing, said drive actuator being operatively connected to said main body to effect reciprocating movement of said main body along said pump housing with said piston moving with said main body within said inner bore to vary said respective first and second volumes; and said end caps including inlet and outlet passages which communicate with said first and second pump chambers through said pump tube bores for supplying an inlet fluid to an expanding one of said first and second pump chambers and receiving a pressurized fluid from a contracting one of said first and second pump chambers, said guide members being formed as hollow guide tubes which are disposed in fluid communication with said inlet and outlet passages.

13. The piston pump according to claim 12, wherein said housing unit includes elongate connectors having opposite end sections joined to said end caps so as to axially join said end caps together in axially spaced relation.

14. The piston pump according to claim 13, wherein said hollow guide tubes members and said pump tube are confined axially between said end caps and held in position by said connectors joined to said end caps with said opposite ends of said hollow guide tubes and said pump tube being seated in said respective guide member bores and said pump tube bores.

15. The piston pump according to claim 13, wherein said connectors are formed as bolts which tightly draw said end caps, said guide tubes and said pump tube axially together.

16. The piston pump according to claim 13, wherein said hollow guide tubes have said opposite ends sealed by gaskets provided in said guide member bores.

17. The piston pump according to claim 12, wherein said hollow guide tubes have said opposite ends sealed by gaskets provided in said guide member bores.

18. The piston pump according to claim 17, wherein said piston pump is a dual-acting piston pump which continuously pumps the fluid, wherein said inlet and outlet passages are respectively connected through said hollow guide tubes to said first and second pump chambers as said piston moves in a first direction to expand said first volume and contract said second volume, and to said second and first pump chambers as said piston moves in an opposite second direction to contract said first volume and expand said second volume.

19. The piston pump according to claim 12, wherein said main body includes side sections which define elongate guide bores through which said hollow guide tubes extend, bearings being provided in said guide bores to slidably support said side sections of said main body on the hollow guide tubes.

20. The piston pump according to claim 19, wherein said main body and said piston include magnetically attracted bodies which define a magnetic connection between said main body and said piston through said tube wall.

21. The piston pump according to claim 20, wherein said magnetically attracted bodies comprise an outer magnet set supported on said main body and an inner magnet set supported on said piston, said main body including a center section disposed adjacent said pump tube and carrying said outer magnet set such that said inner and outer magnet sets are separated by said tube wall.

22. A piston pump for a fluid, comprising:

a housing unit comprising a non-magnetic pump tube having a tube wall, which defines an inner pump bore having opposite open ends, and a plurality of elongate, hollow guide tubes which have respective opposite open ends and extend along and substantially parallel to said pump tube, said housing unit further including axially-spaced, first and second end caps joined to said each of said opposite open ends of said pump tube and said hollow guide tubes;

a piston within said inner bore that subdivides said inner pump bore into first and second piston chambers which open axially towards said first and second end caps through said opposite open ends of said inner pump bore, said piston being reversibly movable within said inner pump bore in reversible, first and second pumping directions so as to alternatingly expand and contract respective first and second volumes of said first and second piston chambers during piston movement;

a main body slidably supported on said hollow guide tubes so as to reciprocate along an exterior of said pump tube, said main body being reversibly movable along said hollow guide tubes and being magnetically coupled to said piston solely by a magnetic attraction acting through said tube wall between said main body and said piston;

a drive actuator located on said housing unit and driving said main body to effect reciprocating movement of said main body and said piston together to vary said respective first and second volumes; and said first and second end caps including inlet and outlet passages which communicate with said first and second pump chambers and said hollow guide tubes through said respective opposite open ends for supplying an inlet fluid to an expanding one of said first and second pump chambers and receiving a pressurized fluid from a contracting one of said first and second pump chambers.

23. The piston pump according to claim 22, wherein said piston pump is a dual-acting piston pump which continuously pumps the fluid, wherein said inlet and outlet passages are respectively connected to said first and second pump chambers as said piston moves in said first pumping direction to expand said first volume and contract said second volume, and are respectively connected to said second and first pump chambers as said piston moves oppositely in said second pumping direction to contract said first volume and expand said second volume.

24. The piston pump according to claim 22, wherein said first and second end caps include pump tube bores and guide tube bores that receive opposite ends of said pump tube and said hollow guide tubes therein.

25. The piston pump according to claim 24, wherein said pump tube bores and said guide tube bores include respective gaskets for preventing fluid leakage from said pump tube and said hollow guide tubes.

26. The piston pump according to claim 22, wherein said inlet and outlet passages comprise an inlet port and an outlet port each located on a respective one of said first and second end caps, said inlet and outlet passages including flow control devices which alternatingly connect said inlet and outlet ports to either said first and second pump chambers or said second and first pump chambers depending upon the reciprocation of said piston through either said first or said second pumping directions.

27. The piston pump according to claim 26, wherein said inlet port has a first fluid connection with said first pump chamber and a second fluid connection with said second pump chamber, one of said first and second fluid connections extending directly from said inlet port to one end of said inner pump bore through said respective one of said first and second end caps on which said inlet port is located and the other of said first and second fluid connections extending from said inlet port through one of said hollow guide tubes to an opposite end of said inner pump bore, and wherein said outlet port has a third fluid connection with said first pump chamber and a fourth fluid connection with said second pump chamber, one of said third and fourth fluid connections extending directly from said outlet port to one end of said inner pump bore through said respective one of said first and second end caps on which said outlet port is located and the other of said third and fourth fluid connections extending from said outlet port through another one of said hollow guide tubes to an opposite end of said inner pump bore.

28. The piston pump according to claim 27, wherein said flow control devices automatically change inlet and outlet fluid flows through said first fluid connection, said second fluid connection, said third fluid connection and said fourth fluid connections depending upon the reciprocation of said piston through either said first or said second pumping directions.

29. The piston pump according to claim 28, wherein said flow control devices comprises pressure-responsive check valves which open or close in response to the reciprocation of said piston.

* * * * *